United States Patent [19]

Nelson

[11] Patent Number: 4,798,162

[45] Date of Patent: Jan. 17, 1989

[54] EASTER EGG DECORATING DEVICE

[76] Inventor: Robert T. Nelson, 321 Bay Ave., Huntington, N.Y. 11743

[21] Appl. No.: 75,105

[22] Filed: Jul. 20, 1987

[51] Int. Cl.[4] ..... B05C 3/02

[52] U.S. Cl. ..... 118/26; 118/406; 118/423; 118/503; 118/505; 426/250; 426/298; 248/309.1; 248/316.5; 211/14; 434/84; 427/282

[58] Field of Search ..... 118/503, 505, 26, 30, 118/406, 25, 31; 427/282, 443.2; 428/542.2; 426/250, 104, 298, 383; 211/14; 248/309.1, 316.5; 292/322, 320, 318, 319, 321; 8/150; 434/84

[56] References Cited

U.S. PATENT DOCUMENTS

| | | | |
|---|---|---|---|
| 734,085 | 7/1903 | O'Mara et al. | 118/505 X |
| 1,538,367 | 5/1925 | Young | 426/250 |
| 1,829,689 | 10/1931 | Townley et al. | 426/250 |
| 1,876,072 | 9/1932 | Noonan | 211/14 X |
| 1,952,612 | 3/1934 | Sherwood | 426/250 |
| 2,074,376 | 3/1937 | Dorcey | 426/298 X |
| 2,935,773 | 5/1960 | Weckesser | 292/322 |
| 3,321,316 | 5/1967 | De Paolis et al. | 426/298 |
| 4,181,745 | 1/1980 | Growe et al. | 426/298 X |
| 4,531,475 | 7/1985 | Thill | 118/505 X |
| 4,572,850 | 2/1986 | Bailey | 427/430.1 |

*Primary Examiner*—Shrive Beck
*Assistant Examiner*—Alain Bashore
*Attorney, Agent, or Firm*—Collard, Roe & Galgano

[57] ABSTRACT

An Easter egg decorating device is provided which securely holds an egg so that the entire surface thereof may be colored in a coloring bath and which is used in conjunction with a pattern which leaves an area of the egg defined by the pattern uncolored. The decorating device includes a pair of substantially oval shaped cylindrical segments having a yieldable absorbent diaphragm covering an open mouth of each, the segments are adjustably interconnected so that they are substantially axially aligned with the diaphragm covered mouths thereof facing each other, the adjustment permitting the axial distance between the segments to be varied.

2 Claims, 3 Drawing Sheets

EASTER EGG DECORATING DEVICE

BACKGROUND OF THE INVENTION

The present invention relates generally to a device used in connection with the coloring of Easter eggs and, more particularly, it relates to a device which holds an egg when it is immersed in a coloring bath so as to permit a desired design to be incorporated in the coloring operation thereby resulting in the easy and simple decoration of the egg.

One of the traditions of the Easter celebration in the United States and in many other parts of the world relates to the Easter egg, which is a chicken egg which has been dyed or decorated and given as a gift or used as a decoration. Such Easter eggs are most often colored and/or decorated by individuals rather than commercial establishments seeking to make a profit from their sales. Many handsomely colored and decorated Easter eggs are produced by individuals who are willing or able to spend the time to hand-decorate or paint the individual eggs. Apart from the laborious task of individually hand-painting the decorations on the eggs, eggs are often colored in a single uniform color by immersing the eggs in a container of appropriate dye, after which the dyed eggs are dried. Up to now, there has been very little effort to provide a device or means to aid in the decorating of Easter eggs which would alleviate the painstaking and laborious task of individually decorating such eggs by hand.

SUMMARY OF THE INVENTION

It is, therefore, the object of the present invention to provide a device which holds an egg suspended in a coloring bath in a manner such that a defined area or defined areas of the egg remain uncolored by the dye in the coloring bath thereby resulting in a decorated egg.

The above object, as well as others which will hereinafter become apparent, is accomplished in accordance with the present invention by means of an egg holding device which permits the egg to be suspended in a coloring bath so that the entire surface thereof may be contacted by the dye of the coloring bath and wherein a cut-out design, which is impervious to the dye, is used in conjunction with the holding device to impart a design or decoration to the dyed egg. The holding device includes two similar oval or oblong shaped cylindrical segments which are adapted to be substantially axially aligned one with the other with each having at their aligned faces a yieldable, absorbent, diaphragm-like netting such as cheesecloth extended thereover so that an egg positioned between the facing nettings of the two holder halves is securely held therebetween. The two holder halves are releasably interconnected by an adjustable means which permits adjustment of the axial distance between the holder halves so that variations in egg size and shape can be accommodated. The holder together with the egg can then be immersed in a coloring dye so as to color the egg. Since the web of material, such as cheesecloth, is absorbent, the coloring dye will pass through the material and color the egg completely. In order to create a design on the egg which is uncolored by the coloring dye, a pattern of the design which is impermeable to the coloring dye is positioned on the egg and urged thereagainst by the web material. Thus, since the pattern is impervious to the dye, the design and shape thereof on the egg remains uncolored.

Other objects and features of the present invention will become apparent from the following detailed description considered in connection with the accompanying drawings. It is to be understood, however, that the drawings are designed as an illustration only and not as a definition of the limits of the invention.

BRIEF DESCRIPTION OF THE DRAWINGS

In the drawings, wherein similar reference characters denote similar elements throughout the several views.

DESCRIPTION OF THE PREFERRED EMBODIMENTS

Figure 2:
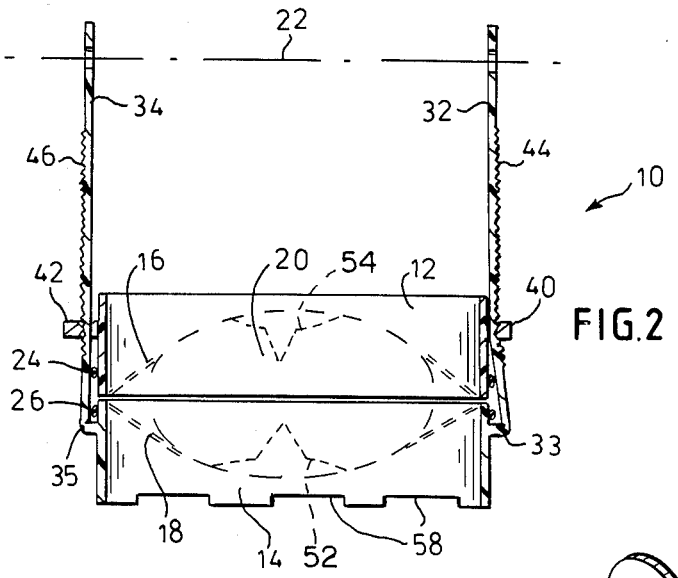
FIG. 2 is a cross-sectional view of the egg holder of FIG. 1 taken along line 2—2 of FIG. 1.
Figure 1:
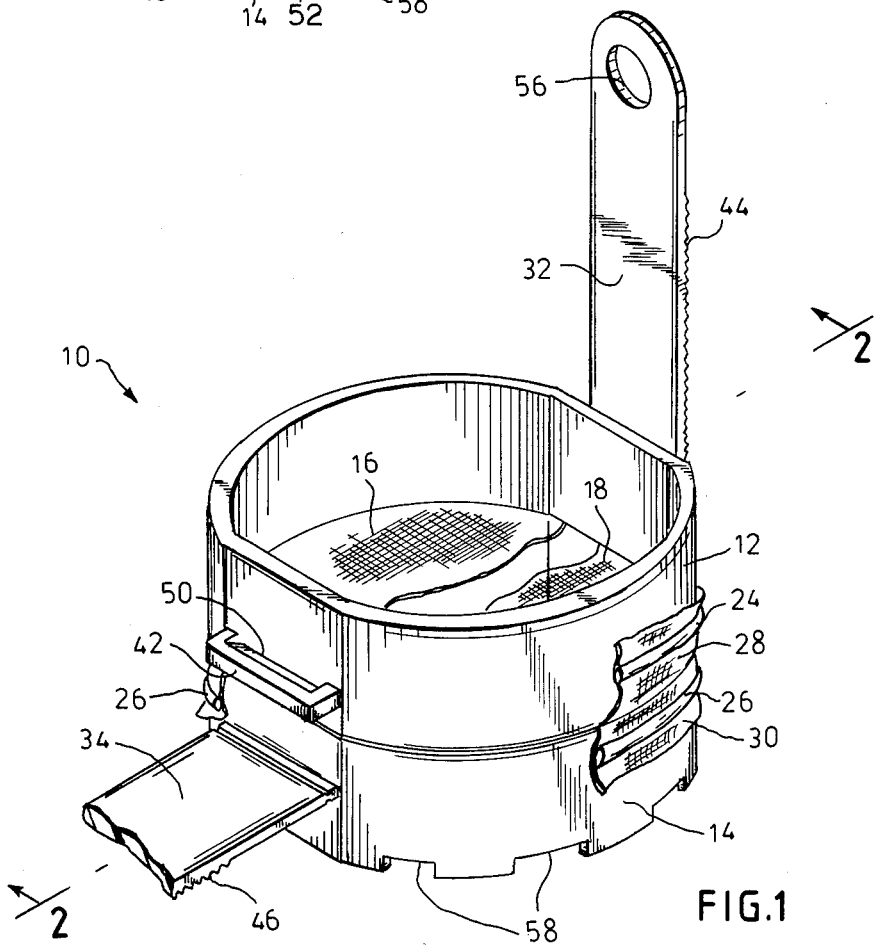
FIG. 1 is a perspective view of the egg holder according to the present invention.
Figure 3:
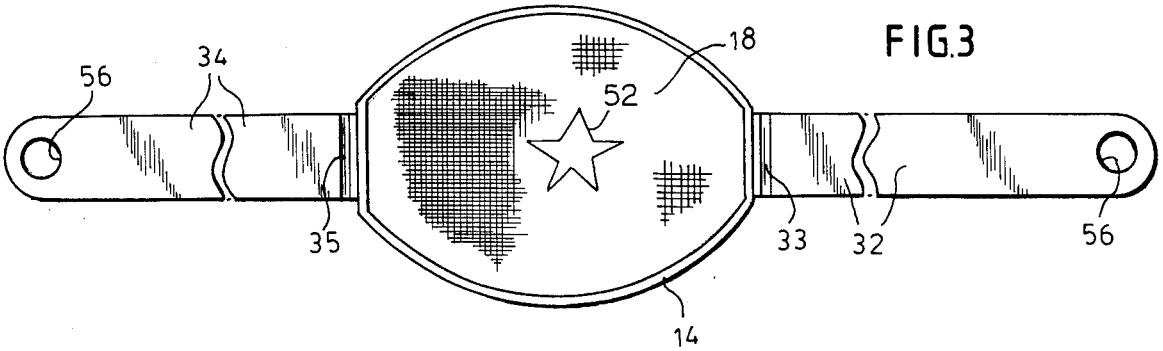
FIG. 3 is a plan view of the bottom half of the egg holder of the present invention.
Figure 4:
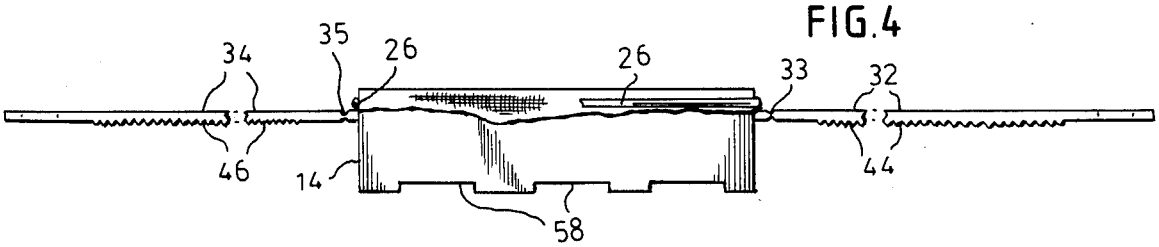
FIG. 4 is a side elevational view of the bottom half of the egg holder shown in FIG. 3.
Figure 5:
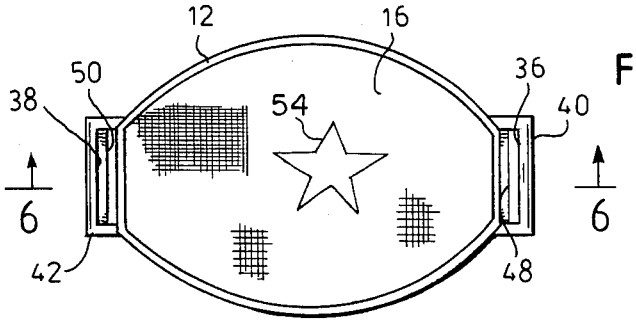
FIG. 5 is a plan view of the upper half of the egg holder of the present invention.
Figure 6:
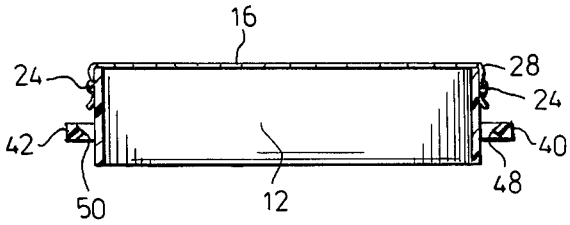
FIG. 6 is a side elevational view of the upper half of the egg holder as shown in FIG. 5.

Now turning to the drawings, there is shown in FIG. 1 an Easter egg holder, generally designated 10, according to the present invention. Egg holder 10 basically consists of substantially similar, oval-shaped, cylindrical segments or halves 12 and 14 which are substantially axially aligned. Each egg holder half 12 and 14 is provided with a yieldable, diaphragm-like membrane, designated 16 and 18, respectively, which cover the mouths of the respective cylindrical segments which face each other, as seen clearly in FIG. 2. The diaphragm-like members 16 and 18 are preferably formed of a material which is somewhat yieldable and permeable so that, when an egg 20 (shown in phantom in FIG. 2) is held between the permeable membrane-like members submerged in a bath of dye 22, as seen in FIG. 2, the liquid dye passes through the absorbent material and contacts the egg throughout the surface thereof. It has been found that cheesecloth is a suitable material for use for membrane members 16 and 18. Membrane members 16 and 18 may be formed integrally with the respective cylindrical segments 12 and 14 or secured to the respective cylindrical segment by any suitable releasable means such as rubberbands 24 and 26. As clearly seen in FIG. 1, a skirt portion 28 of membrane member 16 overhangs the outer wall of cylindrical segment 12 and is releasably secured thereagainst by means of rubberband 24. Similarly, membrane member 18 also has a skirt portion 30 which overhangs the outer wall of cylindrical segment 14 and is releasably constrained thereagainst by means of rubberband 26.

In order to constrain egg 20 between membrane members 16 and 18, upper and lower cylindrical segments 12 and 14 are adjustably interconnected so as to be substantially aligned such as by means of opposing tie straps 32 and 34 which are hingedly connected to and extend from lower cylindrical segment 14. Straps 32 and 34 are sufficiently flexible to be threaded through the respective openings 36 and 38 of ears 40 and 42 of upper cylindrical segment 12. A ratchet-like engagement is provided between the respective tie straps and ears in order to permit adjustable engagement therebetween so as to vary the holding forces applied to egg 20 constrained between the two membrane members. This ratchet-like engagement is provided by means of ratchet-like serrations 44 and 46 on tie straps 32 and 34, respectively, and engagement cams 48 and 50 of ears 40 and 42, respectively.

In the operation of Easter egg holder 10 according to the present invention, an egg 20 is positioned on membrane member 18 of cylindrical segment 14 and the tie straps 32 and 34 are raised as in FIG. 2 by bending the same at hinges 33 and 35, respectively A design in the form of a pattern, designated 52, is positioned on the cheesecloth membrane member 18 of lower cylindrical segment 14 prior to the positioning of egg 20 thereon. If two such designs are desired, then an additional pattern 54 is positioned on cheesecloth membrane member 16 of cylindrical segment 12 prior to positioning the same over egg 20 After positioning the egg and the desired pattern or patterns, the tie straps 32 and 34 are threaded through openings 36 and 38 of ears 40 and 42 to the desired length such that egg 20 is firmly held between the membrane members and the patterns firmly pressed thereagainst. Egg 20 and holder 10 are then immersed in dye bath 22 for as long as the coloring of egg 20 takes. Upon removal from the bath, egg holder 10 can be positioned on a flat surface or suspended from openings 56 in tie straps 32 and 34. If holder 10 is positioned on a flat surface for drying purposes, any liquid dye which runs off the egg or the holder will escape through openings or cuts 58 provided along the bottom of the side wall of cylindrical segment 14. These openings or cuts 58 also promote the circulation of the liquid dye through holder 10 when the holder and egg 20 are immersed in a bath of dye 22.

Figure 7:
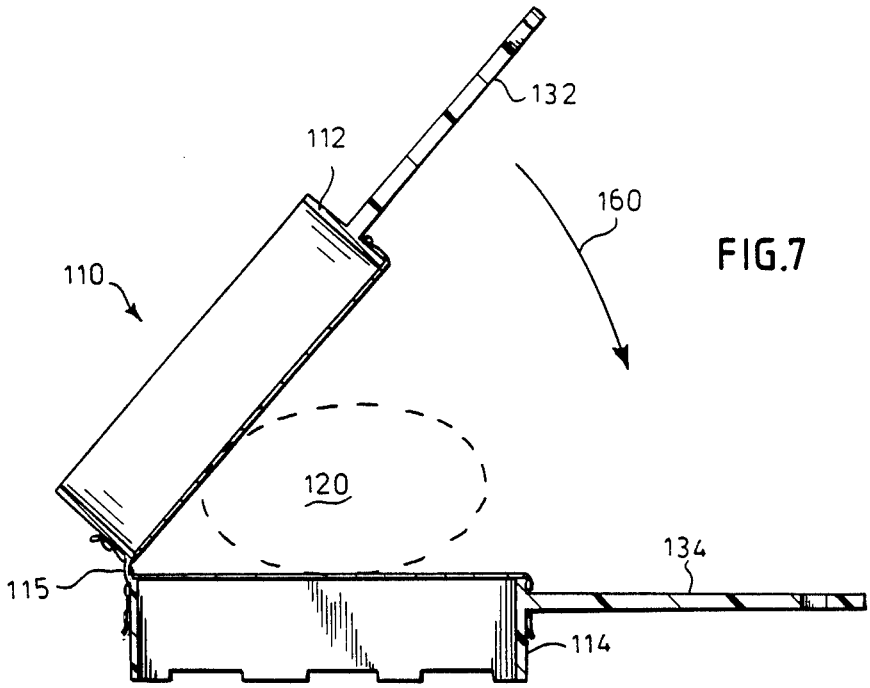
FIG. 7 is a side elevational view of another embodiment of the egg holder according to the present invention.

In FIG. 7, there is shown another embodiment of an Easter egg holder, designated 110, wherein the elements thereof are essentially identical to the elements of Easter egg holder 10 of FIGS. 1 to 6 except that upper and lower cylindrical segments are connected together by a hinge 115. Also, rigid arms 132 and 134 extend from cylindrical segments 112 and 114, respectively, in a direction perpendicular to the axes thereof. In the operation of Easter egg holder 110, the egg 120 (shown in phantom) is positioned between the opposing membrane covered faces of cylindrical segments 112 and 114 and arm 132 is moved toward arm 134 in the direction of arrow 160 until the egg and any desired patterns are firmly secured between the two membrane members. The two arms 132 and 134 are held in this relative position and egg holder 110 together with egg 120 are immersed in a dye bath to color the egg.

Figure 8:
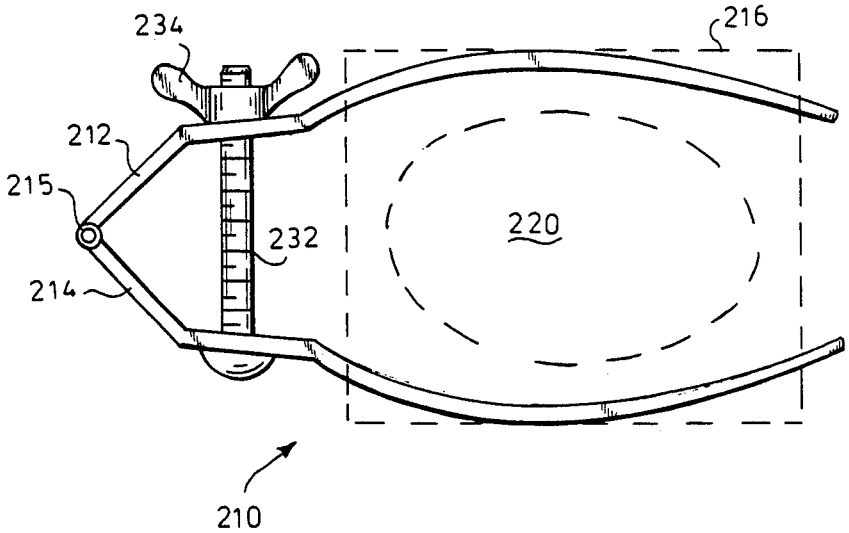
FIG. 8 is a side elevational view of yet another embodiment of the egg holder according to the present invention.

In FIG. 8 yet another embodiment of the present invention is shown wherein Easter egg holder 210 includes a pair of spring biased apart and hingedly connected together elongated members 212 and 214. Hinge 215 is a spring loaded hinge which biases members 212 and 214 apart. Bolt 232 extends between members 212 and 214 and together with wing nut 234 adjust the separation between the two members. In operation, a cylindrically-shaped membrane member, designated 216 (shown in phantom), is spread between arms 212 and 214 and an egg 220 (also shown in phantom) is inserted within the folds of member 216 between arms 212 and 214. Arms 212 and 214 are then separated by adjusting wing nut 234 until membrane member 216 is stretched sufficiently to secure egg 220. As in the previous embodiments, the patterns for the design are sandwiched between egg 220 and the folds of membrane member 216.

While a few embodiments of the present invention have been shown and described, it will be obvious that many changes and modifications may be made thereunto without departing from the spirit and scope of the invention.

What is claimed is:

1. An Easter egg decorating device which securely holds an egg so that the entire surface thereof may be colored in a coloring bath and which is used in conjunction with a pattern which leaves an area of the egg defined by the pattern uncolored, said device comprising:

(a) a substantially oval shaped first cylindrical segment having a cheesecloth diaphragm covering one open mouth thereof;

(b) a substantially oval shaped second cylindrical segment having a cheesecloth diaphragm covering one open mouth thereof; said cheesecloth diaphragms being permeable to the coloring fluid in the coloring bath, and each having a skirt portion overhanging the respective cylindrical segment releasably secured to the segment by a rubberband which engages the skirt portion of the diaphragm and clamps it to the segment;

(c) means interconnecting said first and second cylindrical segments so that they are substantially axially aligned with the diaphragm covered mouths thereof facing each other, said means comprising first and second straps hingedly connected to the outer surface of said first cylindrical segment and oppositely disposed from one another, ears axially aligned with said straps extending from the outer surface of said second cylindrical segment and having openings therein for receiving said respective straps, and ratchet-like serrations extending along each strap and an engagement cam associated with each ear which engages said serrations for releasable and adjustable engagement of said straps with said ears, so that the egg may be held between the diaphragms with sufficient force that the pattern is pressed against the egg so as to exclude the coloring bath therefrom.

2. The device as defined in claim 1, wherein openings are formed in said first cylindrical segment annularly about the open mouth thereof opposing the mouth including said diaphragm.

* * * * *